US009406995B2

(12) United States Patent
Murphy

(10) Patent No.: US 9,406,995 B2
(45) Date of Patent: Aug. 2, 2016

(54) COLLAPSIBLE HELICAL ANTENNA

(71) Applicant: Patric Murphy, Brantford (CA)

(72) Inventor: Patric Murphy, Brantford (CA)

( * ) Notice: Subject to any disclaimer, the term of this patent is extended or adjusted under 35 U.S.C. 154(b) by 662 days.

(21) Appl. No.: 13/261,619

(22) Filed: Mar. 15, 2013

(65) Prior Publication Data

US 2013/0292526 A1 Nov. 7, 2013

Related U.S. Application Data

(63) Continuation of application No. PCT/CA2011/001143, filed on Oct. 13, 2011.

(60) Provisional application No. 61/405,694, filed on Oct. 22, 2010.

(51) Int. Cl.
*H01Q 1/12* (2006.01)
*H01Q 1/08* (2006.01)
*H01Q 11/08* (2006.01)

(52) U.S. Cl.
CPC ..... *H01Q 1/1235* (2013.01); *H01Q 1/08* (2013.01); *H01Q 1/1228* (2013.01); *H01Q 11/08* (2013.01)

(58) Field of Classification Search
CPC ..... H01Q 1/1235
USPC ..... 248/157
See application file for complete search history.

(56) References Cited

U.S. PATENT DOCUMENTS 5,909,197 A * 6/1999 Heinemann ..... H01Q 1/1235 343/880
7,574,832 B1 * 8/2009 Lieberman ..... E04H 12/10 212/350
2011/0221646 A1 * 9/2011 Dresel ..... H01Q 1/08 343/792.5

* cited by examiner

*Primary Examiner* — Dameon E Levi
*Assistant Examiner* — Andrea Lindgren Baltzell

(57) ABSTRACT

The present concept a helical antenna boom assembly includes a boom assembly, including a boom, and a plurality of rods and stays, each rod operably attached at an upper end of the boom and connected to one end of the stay. The boom assembly includes dish arms operably attached at a lower end of the boom, each dish arm connected to the other end of the stay, wherein the boom assembly moveable between an extended position, and a boom assembly collapsed position, such that in the extended position the stays are held under tension between the dish arms and the rods. The stays are also attached to a helical coil such that the tensioned stays support the helical coil in its correct helical geometry.

14 Claims, 8 Drawing Sheets

Fig. 8
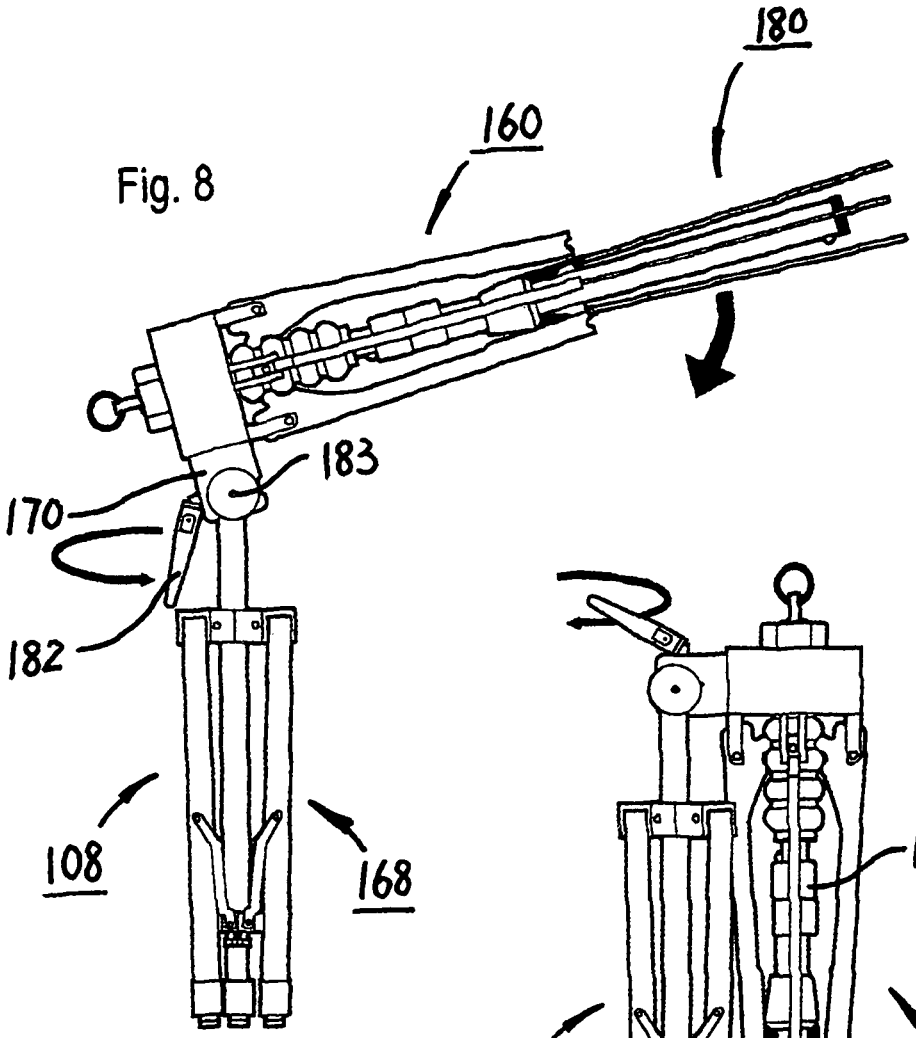
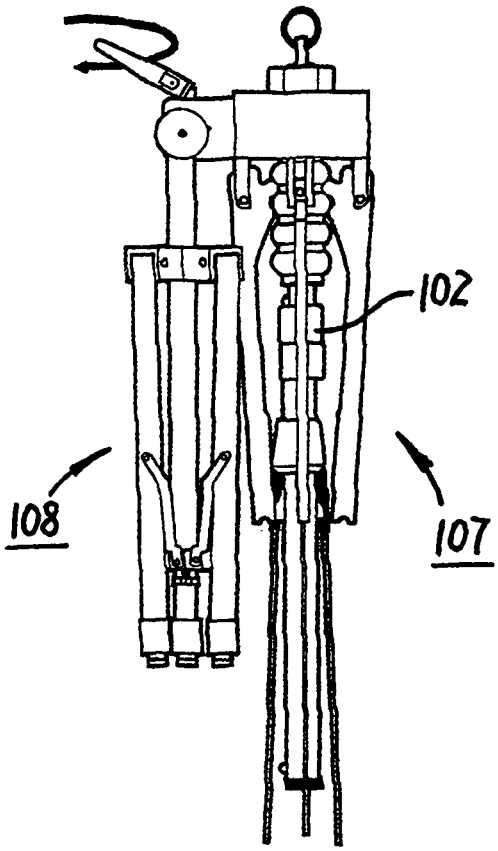
Fig. 9

COLLAPSIBLE HELICAL ANTENNA

FIELD OF THE INVENTION

This application claims priority from previously filed PCT Patent Application No.: PCT/CA2011/001143, titled COLLAPSIBLE HELICAL ANTENNA filed on Oct. 13, 2011 by Patric Murphy which claims priority from previously filed U.S. Provisional Patent Application No. 61/405,694, titled COLLAPSIBLE HELICAL ANTENNA filed on Oct. 22, 2010 by Patric Murphy.

The invention relates generally to helical antennas and more specifically to collapsible helical antennas, which can be used in the field.

BACKGROUND OF THE INVENTION

Helical antennas are widely used and their operating characteristics are well known and understood in the art.

Some helical antennas are designed to remain permanently fixed in their normal operating configuration. On the other hand many applications require a deployable helical antenna that is movable between a collapsed position and extended position in the field. Examples of such deployable helical antennas are shown in U.S. Pat. Nos. 4,068,238, 3,646,566, 6,340,956, 5,977,932, 3,524,193.

Designing a collapsible helical antenna presents a challenge particularly with increasing wavelength. Challenges stem from the relationship between the overall helix diameter and cross-sectional diameter of the helical conductor or radiator and wavelength. In this regard it is known that the optimum overall diameter of the helical antenna is on the order of 0.3 times the central frequency wavelength. The optimum cross-sectional diameter of the helical conductor is on the order of 0.006 times the central frequency wavelength. At longer wavelengths the above relationships yield helix dimensions, which are too large for utilization of conventional helical antenna designs and deployment techniques.

There is a need for a collapsible helical antenna, which can be easily and quickly deployed in the field for reception of satellite signals on the ground.

There is a further need for a collapsible helical antenna, which is lightweight, easily carried on foot and quickly and efficiently deployed on the ground for reception of satellite signals.

SUMMARY OF THE INVENTION

The present concept a helical antenna boom assembly includes:

a) a boom assembly, including a boom, and a plurality of rods and stays, each rod operably attached at an upper end of the boom and connected to one end of the stay;

b) the boom assembly including dish arms operably attached at a lower end of the boom, each dish arm connected to the other end of the stay, c) wherein the boom assembly moveable between an extended position, and a boom assembly collapsed position, d) such that in the extended position the stays are held under tension between the dish arms and the rods, e) wherein the stays are also attached to a helical coil such that the tensioned stays support the helical coil in its correct helical geometry.

Preferably wherein the boom assembly including a rod holder mounted to the upper end of the boom, the rods attached at one end to the rod holder, and attached at the other end to the stays.

Preferably wherein the boom assembly including a hub assembly mounted to the lower end of the boom, wherein the dish arms are attached at one end to the hub assembly and attached at the other end to stays.

Preferably wherein the dish arms including arm pinions for engaging with a rack slidably mounted to the boom, the rack for operatively moving the dish arms from an extended position to an arms collapsed position by manually urging any one of the arms into the desired position.

Preferably such that the hub assembly for selectively locking the rack in a preselected position, and thereby locking the dish arms in the extended position.

Preferably such that the hub assembly for selectively unlocking the rack and thereby releasing the dish arms to permit folding of the dish arms into an arms collapsed position.

Preferably wherein the rods are resiliently biasing the straps thereby maintaining tension on the straps.

Preferably wherein the rods are made of resiliently flexible material thereby tensioning the straps and maintaining linear extension of the straps.

Preferably wherein the boom includes nested telescoping sections such that the boom is moveable between a boom extended position and a boom collapsed position.

Preferably wherein the boom includes an upper segment and a telescopically cooperating lower segment such that the upper segment slides into the lower segment to put the boom in the boom collapsed position.

Preferably further including a coupling for locking the upper segment to the lower segment when the upper section is urged into the boom extended position.

Preferably wherein the boom is made of nested telescoping sections such that the boom is moveable between a boom extended position and a boom collapsed position.

Preferably wherein the boom is made of a tubular section.

Preferably wherein the hub assembly includes an ejector pin slideably mounted within the lower end of a support shaft portion of the lower segment of the boom which is resiliently biased in a locked position for operably locking the rack and thereby the dish arms in the extended position.

Preferably wherein the hub assembly includes a key ring for manually urging the ejector pin downwardly thereby unlocking the rack and allowing the rack and dish arms to be urged into the arms collapsed position.

BRIEF DESCRIPTION OF THE DRAWINGS

The present device will now be described by example only with reference to the following drawings in which:

FIG. 8 is a schematic side elevational view of the antenna frame showing the boom assembly in the collapsed position the tripod in collapsed position and the unlocking of the cam lock for further pivoting and collapsing the tripod in the tripod collapsed position.

FIG. 9 is a schematic side elevational view of the frame showing the entire antenna frame in the frame collapsed position ready for storage.

DESCRIPTION OF THE PREFERRED EMBODIMENTS

Figure 1:
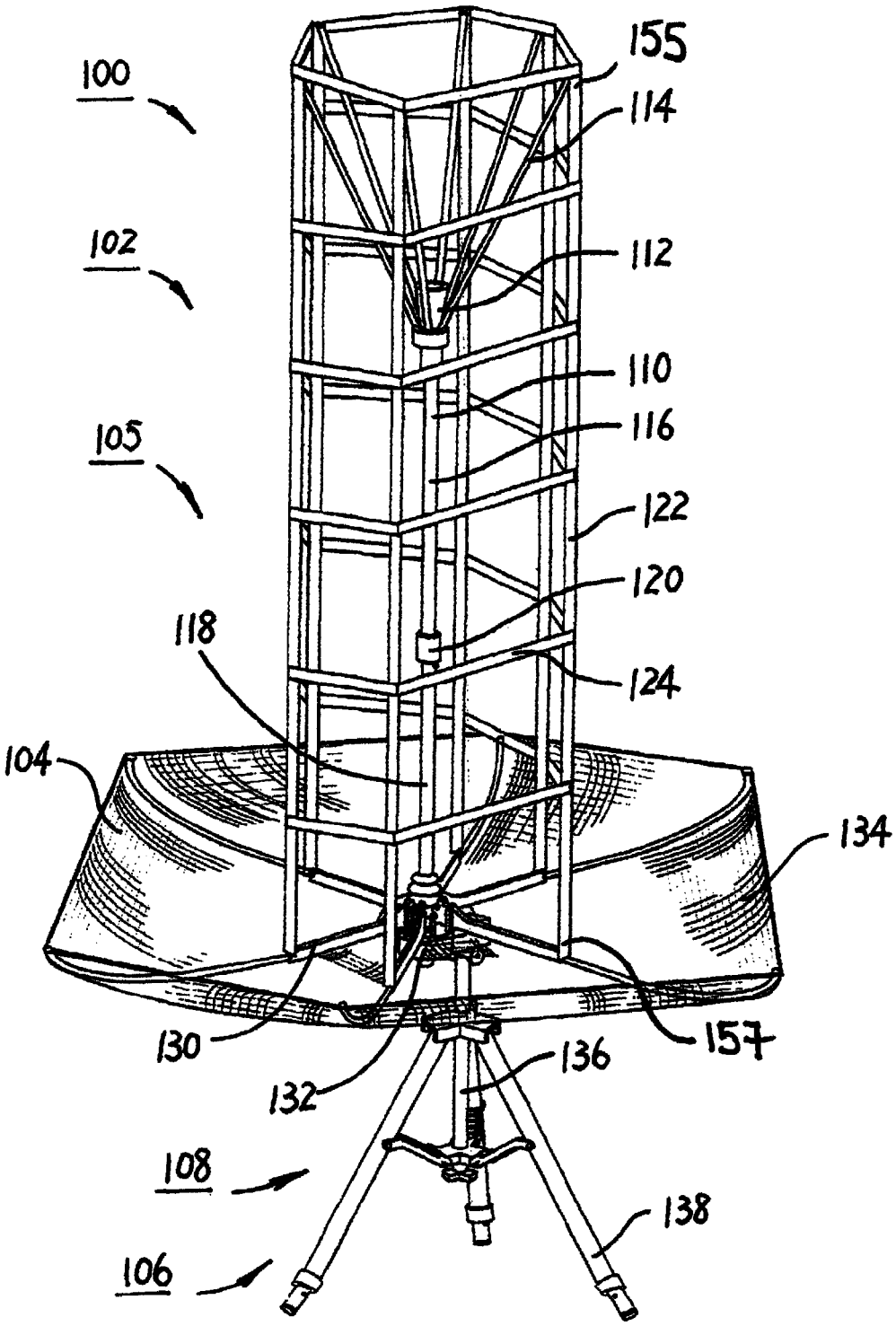
FIG. 1 is a front schematic perspective view of a helical antenna.

The present device a collapsible helical antenna is shown generally as 100 in FIG. 1.

Helical antenna 100 includes a boom assembly 102, which further includes an antenna dish 104 and is shown in an extended position 105 in FIG. 1.

Furthermore helical antenna 100 also includes a tripod assembly 106, which includes a tripod 108.

Boom assembly 102 further includes a boom 110, having an upper end 111 and a lower end 113. The boom assembly includes a rod holder 112 for securely fastening one end of rods 114 thereto. Boom assembly 102 further includes an upper segment 116 a lower segment 118, which is coupled together with coupling 120. Boom assembly 102 also includes stays 122, which support helical coil 124.

Figure 2:
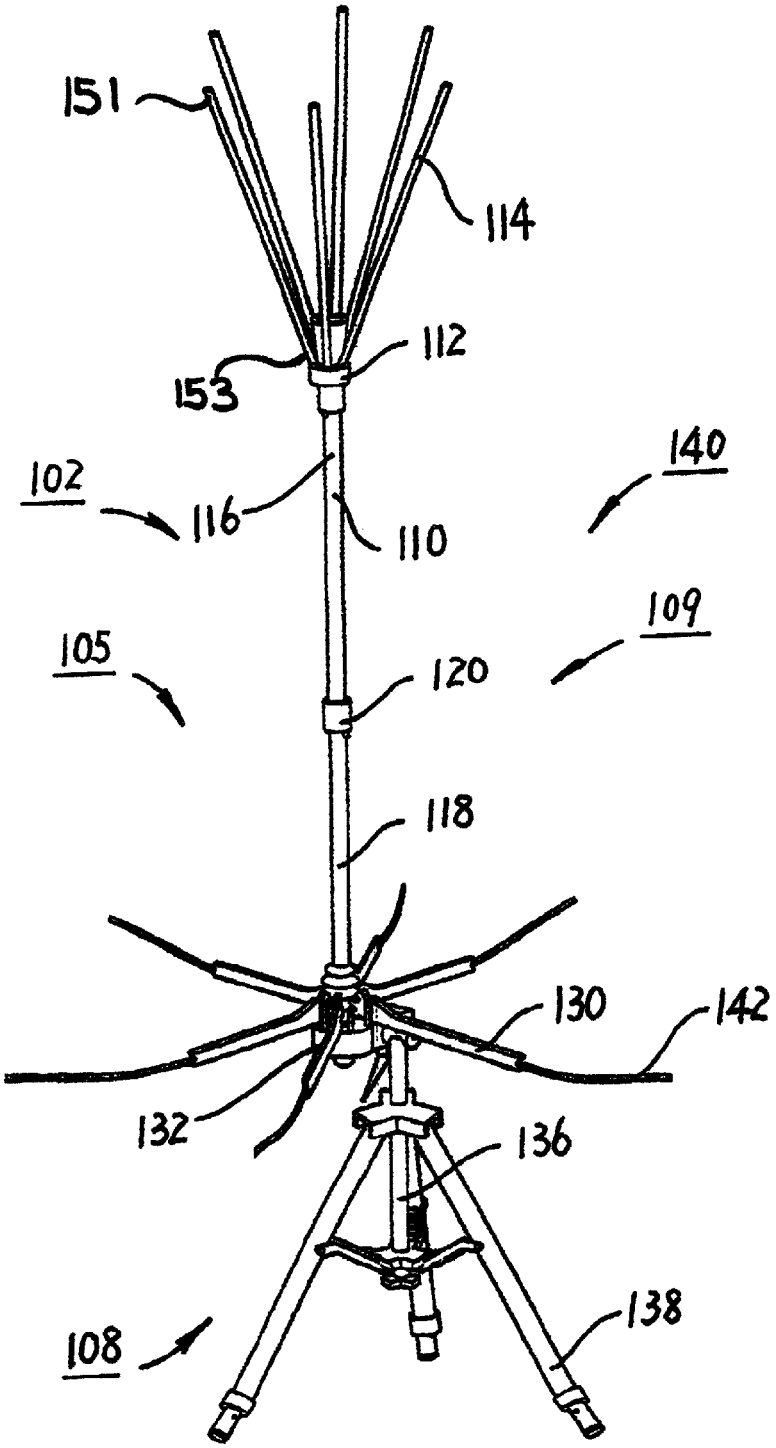
FIG. 2 is a front schematic perspective view of the antenna frame of the helical antenna.

Boom assembly 102 also includes antenna dish 104, which further includes dish arms 130 which are connected to a hub assembly 132 and support a metalized fabric 134. Tripod assembly 106 includes tripod 108 having a tripod mast 136 and tripod legs 138. Referring now to FIG. 2, which shows schematically antenna frame 140 in an extended position 105, and the boom assembly 102 and boom 110 in a boom extended position 109. In the boom extended position 109 the boom 110, rods 114, dish arms 160 and stays 122 are fully extended and in the extended position 105 such that the stays 122 are placed in tension by being stretched between dish arms 130 and rods 114.

The reader will note that antenna frame 140 includes all of the rigid components of helical antenna 100 and does not include stays 122 helical coil 124 and metalized fabric 134 for example.

Boom end 153 of rods 114 is securely fastened to rod holder 112 and stay end 151 of rods 114 is connected to stays 122. The rods are preferably made of resiliently flexible material thereby resiliently biasing the straps and maintaining tension on the straps. For example plastic, fiberglass, steel, wood, aluminum and other materials known in the art may be used for the rods 114. Rods 114 are arranged in a circular inverted conical array and extend above upper end 111 of boom 110. as depicted in FIGS 1 and 2.

Stays 122 are connected at rod end 155 to rods 114 and at dish end 157 to dish arms 130 as depicted in FIG. 1.

Dish arms 130 further include an arm extension 142 for supporting metalized fabric 134 from the end of dish arm 130 to the outer diameter of metalized fabric 134.

Figure 3:
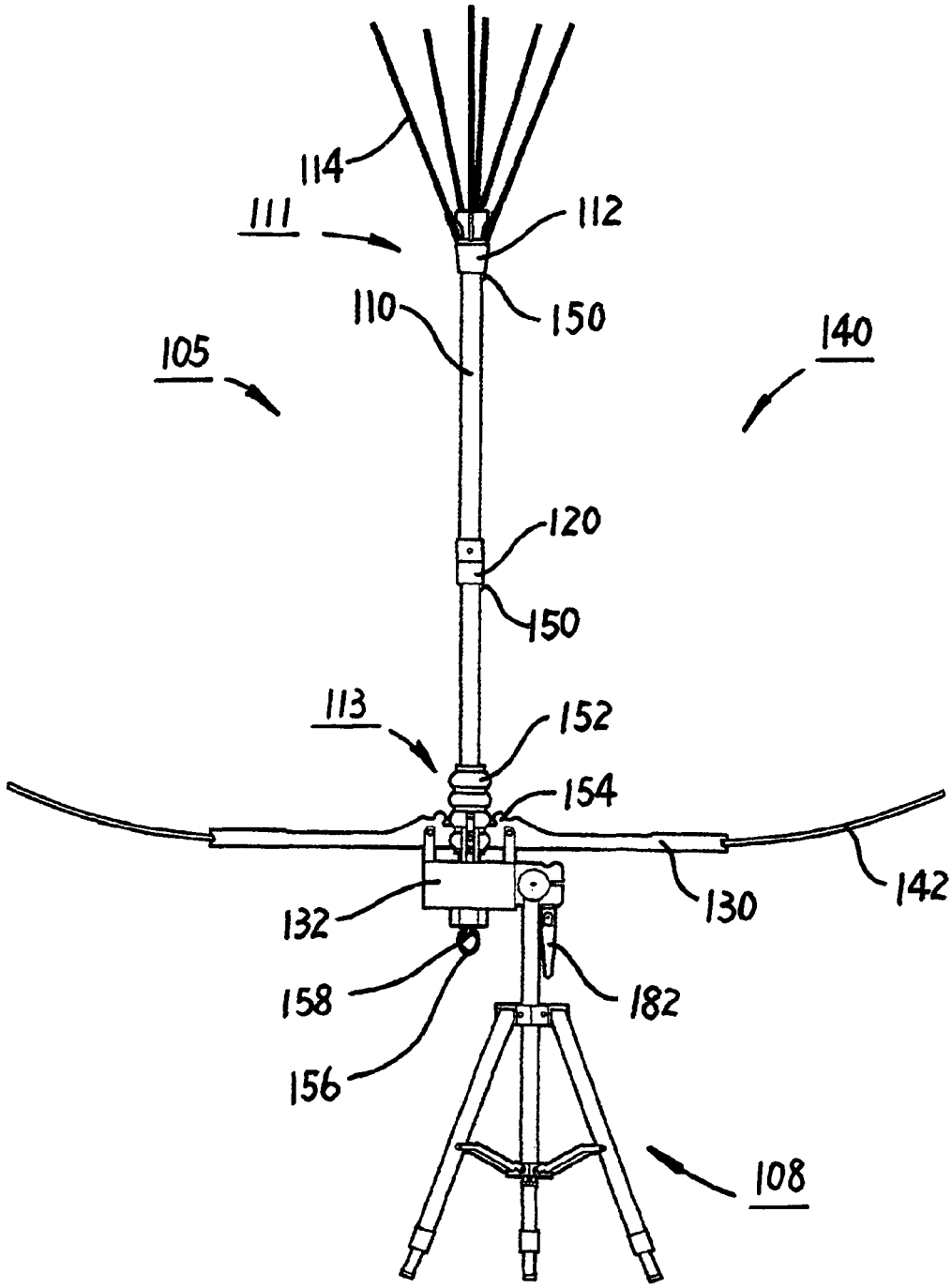
FIG. 3 is a schematic side elevational view of the antenna frame of the helical antenna shown in an extended position.

Referring now to FIG. 3, which shows schematically a side elevational view of antenna frame 140 in an extended position 105.

Boom 110 further includes ball stops 150 located just below rod holder 112 and coupling 120. Hub assembly 132 also further includes a rack 152 and each dish arm 130 includes arm pinions 154 at one end thereof. The rack is slideably mounted onto the support shaft portion 190 part of lower segment 118 of boom 110.

Figure 4:
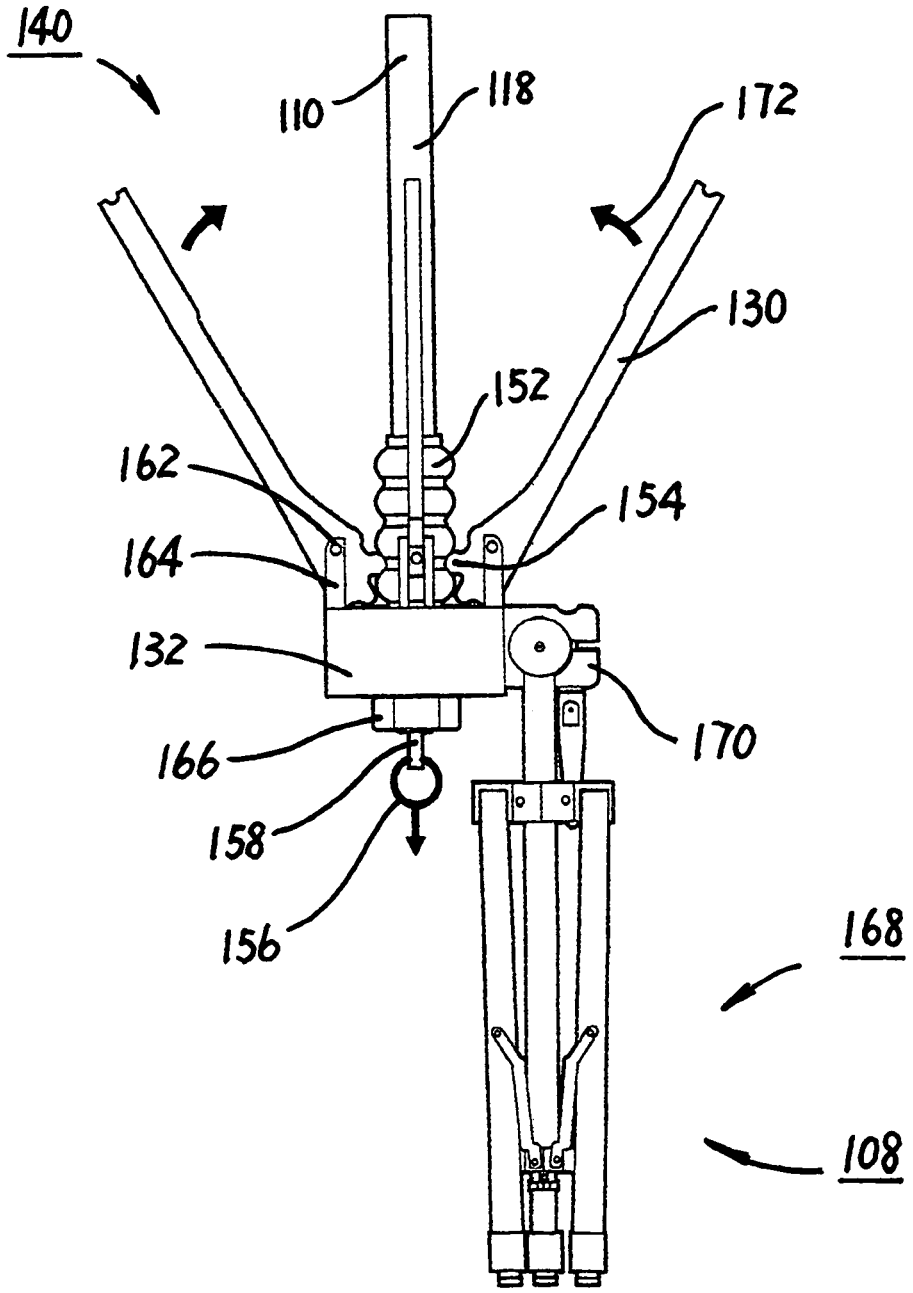
FIG. 4 is a schematic partial side elevational view of a portion of the antenna frame showing the tripod in the tripod collapsed position and showing the motion of the dish arms being collapsed.

Hub assembly 132 also includes an ejector pin 158 which is activated by pulling on key ring 156. Referring now to FIG. 4 which is a partial schematic side elevational view of the antenna frame 140 more specifically showing details as to how dish arms 130 are movable between an extended position 105 and an arms collapsed position 160.

FIG. 4 shows that hub assembly 132 further includes arm supports 164 for pivotly attaching dish arms 130 at arm pivot 162. Rack 152 is urged downwardly by arm pinions 154 when dish arms 130 are moved in the collapsing direction shown as 172.

In order to initiate the collapsing of dish arms 130 the ejector pin 158 is manually urged outwardly by pulling on key ring 156 compressing spring 200 thereby releasing rack 152 and allowing dish arms 130 to move in the collapsing direction shown as 172.

FIG. 4 also shows tripod 108 in a tripod collapsed position 168. The collapsing of tripod 108 and the mechanism involved with this tripod is well known in the art.

Hub assembly 132 further includes a tripod bracket 170, which connects tripod 108 to boom assembly 102.

Referring now to FIGS. 3 and 5 through 9 inclusively which schematically depicts antenna frame 140 being moved from the fully extended position 105 to a fully frame collapsed position 107 as shown in FIG. 9.

Figure 5:
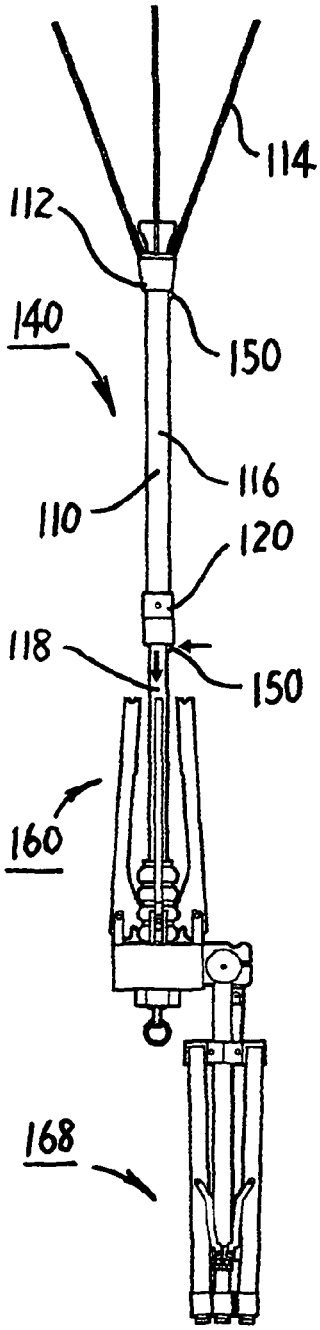
FIG. 5 is a schematic side elevational view of the antenna frame showing the tripod in the tripod collapsed position the dish arms in the arms collapsed position and the balance of the antenna frame in the extended position.

Referring now to FIG. 5 with the tripod shown in the tripod collapsed position 168 and the dish arms 130 shown in the arms collapsed position 160 one further can collapse boom 110 by depressing ball stops 150 thereby lowering upper segment 116 to telescopically move over top of the lower segment 118 of boom 110.

Figure 6:
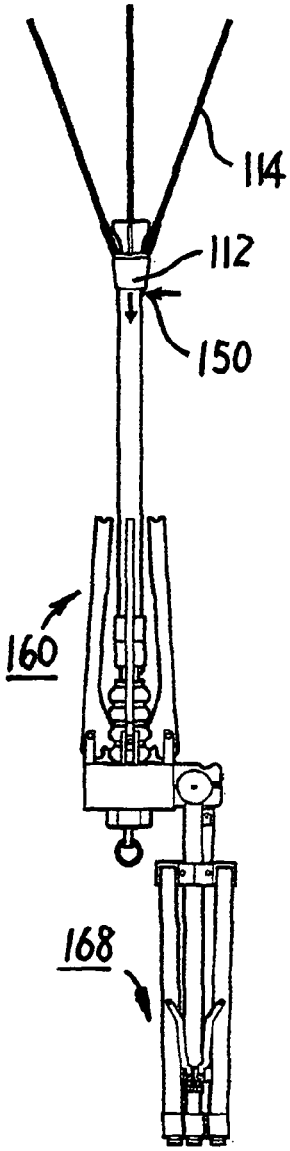
FIG. 6 is a schematic side elevational view of the antenna frame showing the tripod in the collapsed position the arms in the arms collapsed position and the boom in a partially collapsed position.
Figure 7:
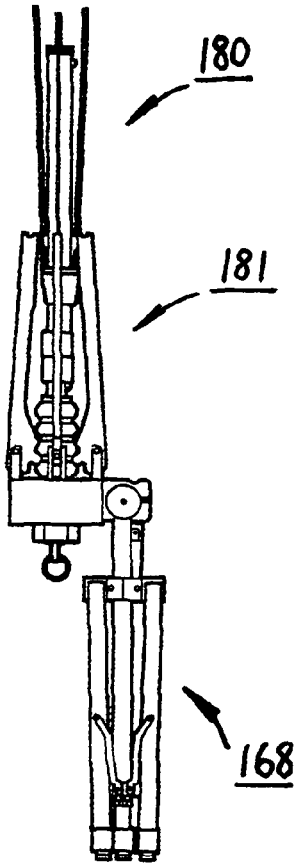
FIG. 7 is a schematic side elevational view of the antenna frame showing the tripod in the collapsed position and the boom in the fully collapsed position.
Figure 10:
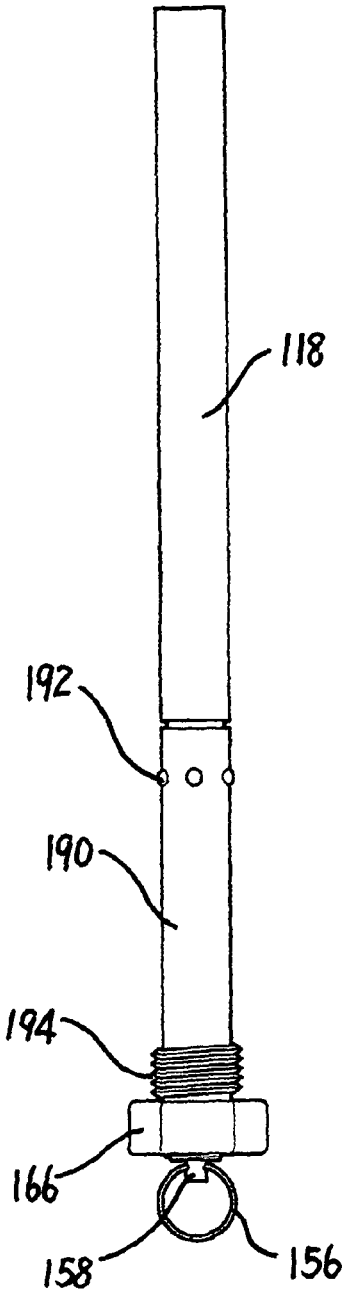
FIG. 10 is a side elevational schematic view of the boom support shaft portion together with a portion of the boom.

Shown in FIG. 6 further depressing the second ball stop 150 just located below rod holder 112 one is then able to collapse the upper portion of boom 110 and retract the rod holder and the rods 114 into a boom assembly collapsed position 181 and boom collapsed position 180 as shown in FIG. 7.

Referring now to FIG. 8 by loosening cam lock 182 of tripod bracket 170 allows tripod 108 to pivot freely about pivot 183 as shown in FIG. 8.

Pivoting tripod 108 about pivot 183 one is able to collapse tripod 108 against collapsed boom assembly 102 shown in boom collapsed position 180 into a frame collapsed position 107 as shown in FIG. 9.

Frame collapsed position 107 is the fully collapsed position of the antenna frame 140.

The reader will note that the flexible portions of the helical antenna 100 such as the stays 122 the helical coil 124 and the metalized fabric 134 will easily collapse with the rigid components of boom assembly 102 and tripod 108 collapsing down into the frame collapsed position 107 as shown in FIG. 9.

For clarity of drawings we have not shown the soft components of helical antenna 100 in order that the reader is able to understand the collapsing features of antenna frame 140.

The reader will note that helical antenna can be moved from the extended position 105 to the fully frame collapsed position 107 by simply reversing this procedure one can deploy helical antenna 100 by simply moving the helical antenna 100 from the frame collapsed position 107 to the extended position 105.

Referring now to FIGS. 10, 11, 12 & 13 which show details of the boom support shaft portion 190, which includes lock balls 192, shaft threads 194, shaft nut 166 as well as ejector pin 158 and key ring 156.

Figure 11:
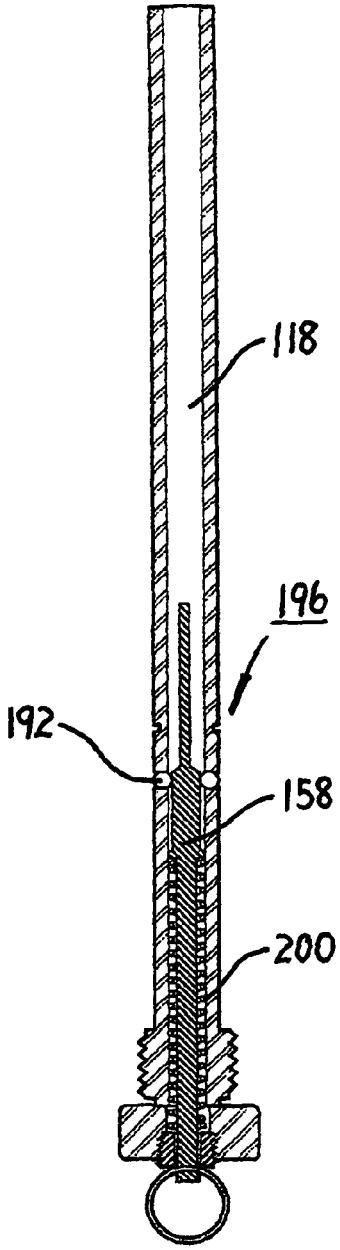
FIG. 11 is a partial cut away schematic side elevational view of the boom support shaft portion showing the details of the ejector pin the lock balls and the spring tensioner arrangement showing the ejector pin in the locked position.

Referring to FIG. 11 ejector pin 158 is shown in a locked position 196 wherein lock balls 192 are positioned such that rack 152 not shown cannot move axially along boom support shaft portion 190.

Figure 12:
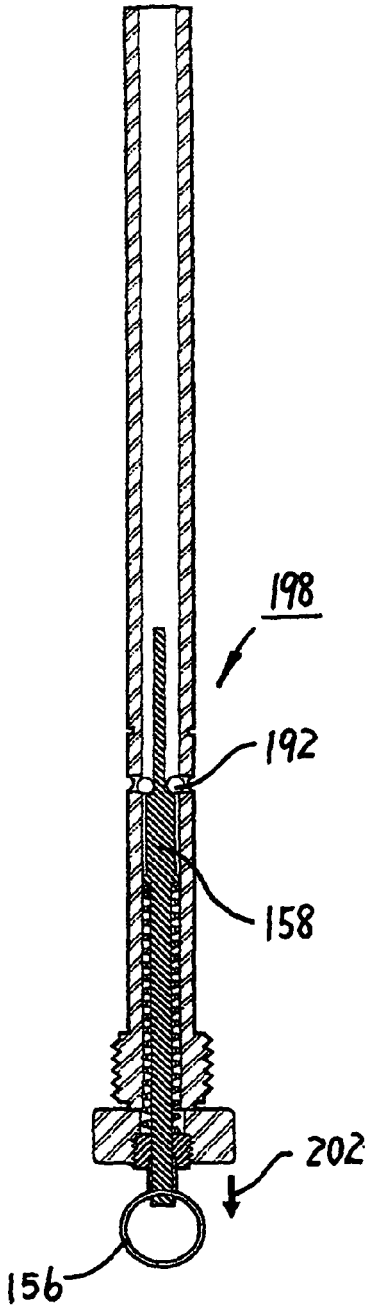
FIG. 12 is a schematic partial cut away side elevational view of the boom support shaft portion showing the ejector pin in the unlocked position.

Referring now to FIG. 12 by urging ejector pin 158 downwardly by pulling on key ring 156 this releases lock balls 192 to move inwardly thereby unlocking rack 152 and allowing it to move axially along boom support shaft portion 190. Boom support shaft portion 190 is shown in the unlocked position 198 thereby allowing dish arms 130 to be moved into the collapsing direction 172 and finally into arms collapsed position 160.

Figure 13:
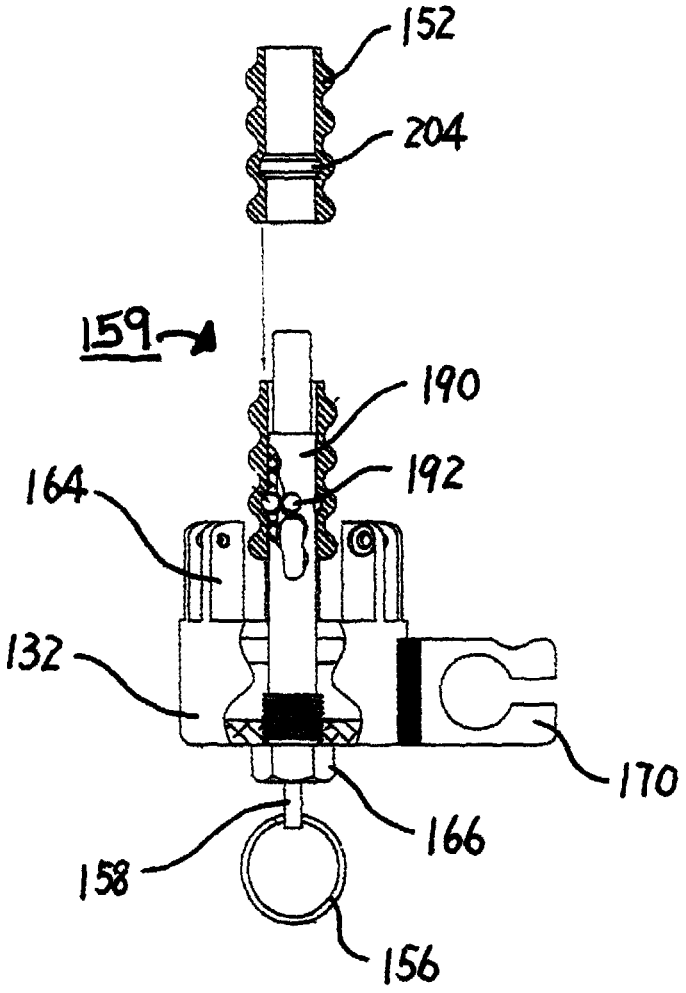
FIG. 13 is a schematic side elevational partial cut away assembly view of the rack being placed over the boom support shaft portion and interacting with the lock balls.

FIG. 13 shows further details in regard to the hub assembly 132 as well as the boom support shaft portion 190.

Referring now to FIG. 13 the reader will see the interaction between rack 152 and the boom support shaft portion 190. Rack 152 is a cylindrical gear profiled rack and includes ball groove 204 for receiving lock balls 192 therein when the ejector pin 158 is resiliently biased by spring 200 in the locked position 196 when the rack 152 is in an upper locked position 159 thereby preventing rack 152 from moving axially along boom support shaft portion 190.

Hub assembly 132 also includes arm supports 164, ejector pin 158, key ring 156, shaft nut 166 and tripod bracket 170 as shown.

In Use:

In use helical antenna 100 is deployed into the extended position 105 as shown as FIG. 1. In extended position 105 stays 122 are under tension being stretched between the end of rods 114 on one end and dish arms 130 on the other end. Tension is applied to stays 122 when boom 110 is telescoped into the extended position 105 and dish arms 130 are also retracted into the extended position as shown in FIGS. 1 and 2. Tension on stays 122 rigidly holds helical coil 124 in place thereby defining the necessary helix required for proper functioning of the antenna. Helical coil 124 is a flexible conductor and may or may not be coated with material and/or entrained inside a material. There are a number of known materials in the art which can be used for helical coil 124 as well as stays 122.

Antenna dish 104 includes metalized fabric 134 which is known in the art and is very flexible and effective in reflecting the signal back to helical coil 124.

Described above is the process for collapsing helical antenna 100 from the extended position 105 to the frame collapsed position 107 shown in FIG. 9. In frame collapsed position 107 the entire helical antenna is put into a very compact position capable of being stored in a small bag.

Due to the design and construction of the helical antenna 100 in collapsed position 107 helical antenna 100 is extremely compact and light and can be easily carried on foot.

It will be apparent to persons skilled in the art that various modifications and adaptations of this structure described above are possible without departure from the spirit of the invention the scope of which is defined in the appended claims.

I claim:

1. A helical antenna boom assembly comprising:

a) a boom assembly, including a boom, and a plurality of resilient rods and stays, the rods arranged in a circular inverted conical array, wherein a boom end of each rod is operably attached at an upper end of the boom at a central rod holder and a stay end of the rods are connected to a rod end of the stays, thereby the rods support the stays in a circular arrangement around the boom;

b) the boom assembly includes dish arms arranged in a circular array around a lower end of the boom and operably attached at a lower end of the boom, each dish arm connected to a dish end of the stay, c) wherein the boom assembly is moveable between an extended position, and a boom assembly collapsed position, d) such that in the extended position the rods are resiliently biased such that the stays are held under tension between the circular array of dish arms and the circular array of rods, e) wherein a flexible conductor helical coil is attached to the stays such that the tensioned stays support the helical coil in its correct helical geometry.

2. The helical antenna boom claimed in claim 1, wherein the boom assembly including a cylindrical rod holder mounted to the upper end of the boom, for connecting the rods to the boom and holding the rods in the circular inverted conical array, wherein each rod extends above an upper end of the boom.

3. The helical antenna boom claimed in claim 2, wherein the boom assembly including a hub assembly mounted to the lower end of the boom, wherein the dish arms are attached at one end to the hub assembly and attached at the other end to the stays.

4. The helical antenna boom claimed in claim 3, wherein the dish arms include arm pinions for pivotally engaging with a cylindrical gear profiled rack which is slidably mounted to the boom, such that all of the dish arms are pivotally connected to the cylindrical gear profiled rack for operatively moving the dish arms from an extended position to an arms collapsed position by manually urging any one of the arms into the desired position which simultaneously moves all of the dish arms in unison to the selected position.

5. The helical antenna boom claimed in claim 4, wherein the cylindrical gear profiled rack includes a ball groove and co-operating lock balls, the rack slidably engages axially along a boom support shaft portion of the boom such that in the extended position the rack is in an upper locked position wherein the lock balls register with the ball groove in the rack for holding the rack stationary and thereby maintaining the dish arms in the extended position.

6. The helical antenna boom claimed in claim 5, wherein the hub assembly further includes an ejector pin slideably received within the support shaft portion of the boom, the ejector pin biased in a normally locked position which maintains the lock balls in engagement with the ball groove in the rack thereby holding the rack stationary and maintaining the dish arms in the extended position.

7. The helical antenna boom claimed in claim 6, wherein the ejector pin is moveable from a locked position to an unlocked position by urging the ejector pin downwardly thereby releasing the lock balls which in turn allows the rack to slide downwardly along the support shaft portion of the boom and thereby allowing the dish arms to retract to an arms collapsed position.

8. The helical antenna boom claimed in claim 1, wherein the rods are made of resiliently flexible material thereby tensioning the stays and maintaining linear extension of the stays.

9. The helical antenna boom claimed in claim 1, wherein the boom includes nested telescoping sections such that the boom is moveable between a boom extended position and a boom collapsed position.

10. The helical antenna boom claimed in claim 1, wherein the boom includes an upper segment and a telescopically cooperating lower segment such that the upper segment slides into the lower segment to put the boom in the boom collapsed position.

11. The helical antenna boom claimed in claim 1, further includes a coupling for locking the upper segment to the lower segment when the upper section is urged into the boom extended position.

12. The helical antenna boom claimed in claim 1, wherein the boom is made of nested telescoping sections such that the boom is moveable between a boom extended position and a boom collapsed position.

13. The helical antenna boom claimed in claim 1, wherein the boom is made of a tubular section.

14. The helical antenna boom claimed in claim 7, wherein the ejector pin includes a key ring for manually urging the ejector pin downward thereby unlocking the rack and allowing the rack and dish arms to be urged into the arms collapsed position.

* * * * *